US011408440B2

(12) United States Patent
Liu et al.

(10) Patent No.: US 11,408,440 B2
(45) Date of Patent: Aug. 9, 2022

(54) STATOR BLADE, COMPRESSOR STRUCTURE AND COMPRESSOR

(71) Applicants: Gree Electric Appliances (Wuhan) Co., Ltd, Wuhan (CN); Gree Electric Appliances, Inc. of Zhuhai, Zhuhai (CN)

(72) Inventors: Zengyue Liu, Zhuhai (CN); Ruixing Zhong, Zhuhai (CN); Liandong Lei, Zhuhai (CN); Yuhui Chen, Zhuhai (CN); Nan Jiang, Zhuhai (CN); Xinwang Ouyang, Zhuhai (CN); Caiyun Jiang, Zhuhai (CN); Yi Zhou, Zhuhai (CN)

(73) Assignees: Gree Electric Appliances (Wuhan) Co., Ltd., Wuhan (CN); Gree Electric Appliances, Inc. of Zhuhai, Zhuhai (CN)

( * ) Notice: Subject to any disclaimer, the term of this patent is extended or adjusted under 35 U.S.C. 154(b) by 229 days.

(21) Appl. No.: 16/613,978

(22) PCT Filed: Dec. 22, 2017

(86) PCT No.: PCT/CN2017/118110
§ 371 (c)(1),
(2) Date: Nov. 15, 2019

(87) PCT Pub. No.: WO2018/209955
PCT Pub. Date: Nov. 22, 2018

(65) Prior Publication Data

US 2021/0332829 A1 Oct. 28, 2021

(30) Foreign Application Priority Data

May 16, 2017 (CN) ..... 201710344335.9

(51) Int. Cl.
*F04D 29/54* (2006.01)
*F04D 19/00* (2006.01)
*F04D 29/56* (2006.01)

(52) U.S. Cl.
CPC ..... *F04D 29/542* (2013.01); *F04D 19/002* (2013.01); *F04D 29/563* (2013.01)

(58) Field of Classification Search
CPC . F01D 5/182; F01D 9/02; F01D 9/041; F04D 17/025; F04D 19/002;
(Continued)

(56) References Cited

U.S. PATENT DOCUMENTS 5,383,766 A * 1/1995 Przirembel ..... F01D 5/186 416/92
5,709,531 A * 1/1998 Nishida ..... F04D 29/444 415/208.4
(Continued)

FOREIGN PATENT DOCUMENTS

CN 101021179 A * 8/2007
CN 101021179 A 8/2007
(Continued)

*Primary Examiner* — Woody A Lee, Jr.
*Assistant Examiner* — Eric A Lange
(74) *Attorney, Agent, or Firm* — The Webb Law Firm

(57) ABSTRACT

The present application provides a stator blade, a compressor structure and a compressor. The stator blade comprises a blade body, wherein a cavity is formed inside the blade body, and a gas supply hole is formed on the blade body. The present application forms a jet on the suction surface of the stator blade by supplemented gas, thereby blowing off the low-speed low-energy region formed by the suction surface, reducing the gas flow mixing loss caused by the supplemented gas, thereby improving the aerodynamic efficiency of the centrifugal compressor.

6 Claims, 1 Drawing Sheet

(58) Field of Classification Search
CPC ..... F04D 29/444; F04D 29/563; F04D 29/44; F04D 29/544; F04D 29/54; F04D 29/684; F04D 29/542; F05D 2240/124; F05D 2250/291
See application file for complete search history.

(56) References Cited

U.S. PATENT DOCUMENTS

| | | | | |
|---|---|---|---|---|
| 2016/0319839 | A1* | 11/2016 | Wang | F04D 27/002 |
| 2020/0158134 | A1* | 5/2020 | Liu | F04D 17/12 |

FOREIGN PATENT DOCUMENTS

| | | | | | |
|---|---|---|---|---|---|
| CN | 101092978 | A | | 12/2007 | |
| CN | 102588303 | A | | 7/2012 | |
| CN | 107120315 | A | | 9/2017 | |
| DE | 1280464 | | | 10/1968 | |
| DE | 102015002025 | A1 | * | 8/2016 | F04D 27/0238 |
| DE | 102015002025 | A1 | | 8/2020 | |
| EP | 3623640 | A1 | | 3/2020 | |
| JP | 2004300929 | A | * | 10/2004 | F04D 29/5846 |
| JP | 2008274818 | A | | 11/2008 | |

* cited by examiner

STATOR BLADE, COMPRESSOR STRUCTURE AND COMPRESSOR

CROSS-REFERENCE TO RELATED APPLICATIONS

This application is the United States national phase of International Application No. PCT/CN2017/118110 filed Dec. 22, 2017, and claims priority to Chinese Patent Application No. 201710344335.9 filed May 16, 2017, the disclosures of which are hereby incorporated by reference in their entirety.

FIELD OF THE INVENTION

The present application relates to the field of compressors, in particular to a stator blade, a compressor structure and a compressor.

BACKGROUND OF THE INVENTION

In the centrifugal refrigeration compressor, the temperature rises sharply since the refrigerant is compressed. And specific volume of the refrigerant gas is large at high temperatures, and the energy consumption of the compressor will increase sharply while ensuring the same refrigerating output. In order to reduce the power consumption of the compressor and improve the refrigeration capacity, a multi-stage compression refrigeration cycle is commonly used.

At present, the most widely used cycle is a "two-stage compression refrigeration cycle with incomplete cooling in the intermediate part" with a flash steam separator (commonly known as an economizer). The two-stage compression refrigeration cycle refers to that the flash steam separated from the economizer mixes with the exhaust gas from the low compression stage, reducing the intake gas temperature of secondary compression stage, the specific volume of the refrigerant gas, and the energy consumption of the compressor.

However, after being compressed by the first stage impeller, the refrigerant needs to be diffused by a diffuser and go through guide stage of a return channel to eliminate eddy, then returns to the secondary impeller inlet. So, the refrigerant flow path is longer, and the friction loss is larger. Moreover, speed and flow direction of the inter-stage supplemented gas is often inconsistent with speed and flow direction of main gas flow, resulting in a large mixing loss.

SUMMARY OF THE INVENTION

The embodiment of the present application provides a stator blade, a compressor structure and a compressor to solve the problem of high gas mixing loss caused by supplemented gas in the prior art.

In order to achieve the above object, an embodiment of the present application provides a stator blade, comprising a blade body, wherein a cavity is formed inside the blade body, and a gas supply hole is formed on the blade body.

In some embodiments, the gas supply hole is provided on a suction surface of the blade body.

In some embodiments, the blade body is made by casting or machining.

The present application also provides a compressor structure comprising the above-described stator blade.

In some embodiments, the compressor structure further comprises a housing on which a gas supply passage is formed in communication with the cavity of the stator blade.

In some embodiments, the compressor structure further comprises a rotor impeller and a secondary impeller, wherein the compressor structure is configured to allow the output gas flow from the rotor impeller pass through the stator blade into the secondary impeller.

In some embodiments, an adjustable guide vane is provided at input side of the rotor impeller.

In some embodiments, a diffuser is provided at output side of the secondary impeller.

In some embodiments, a diffuser vane is provided in diffuser flow passage of the diffuser.

In some embodiments, the stator blade comprises an axial flow blade.

In some embodiments, the rotor impeller comprises an axial flow impeller.

The present application also provides a compressor comprising the above described compressor structure.

The present application forms a jet on the suction surface of the stator blade by supplemented gas, thereby blowing off low-speed low-energy gas region formed on the suction surface, reducing the gas flow mixing loss caused by the supplemented gas, thereby improving the aerodynamic efficiency of the centrifugal compressor.

BRIEF DESCRIPTION OF THE ACCOMPANYING DRAWINGS

DESCRIPTION OF REFERENCE SIGNS

Figure 1:
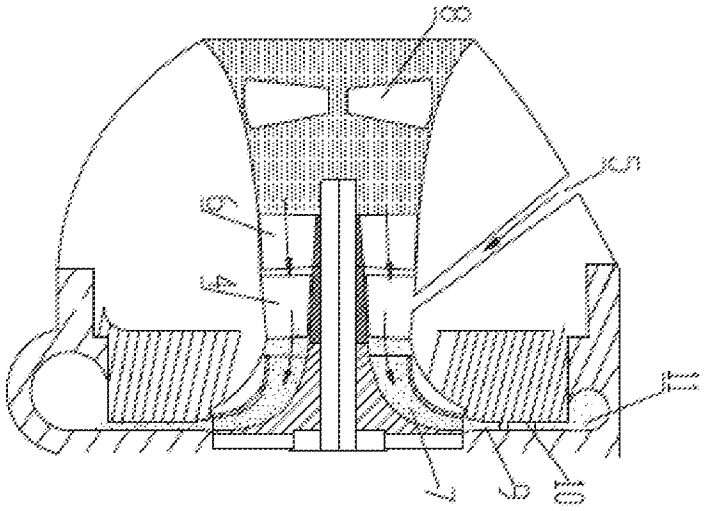
FIG. 1 is a schematic view of an axial force balance structure of a compressor rotor according to an embodiment of the present application.
Figure 2:
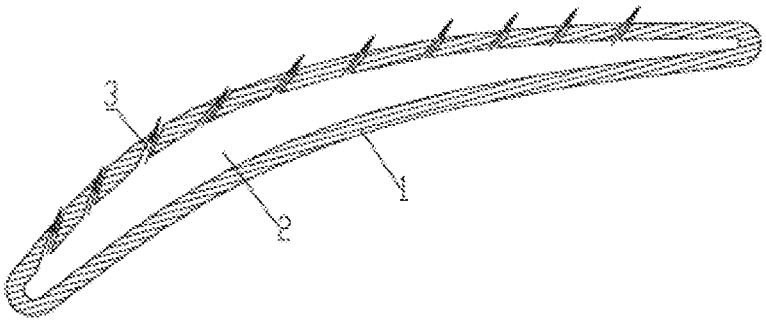
FIG. 2 is a section view of a stator blade according to an embodiment of the present application.

1—blade body;
2—cavity;
3—gas supply hole;
4—stator blade;
5—gas supply passage;
6—rotor impeller;
7—secondary impeller;
8—adjustable guide vane;
9—diffuser flow passage;
10—diffuser blade;
11—volute.

DETAILED DESCRIPTION OF THE PREFERRED EMBODIMENTS

The following is a further detailed description of the present application in combination with the attached drawings and specific embodiments, but not as a limitation of the present application.

The centrifugal refrigeration compressor of the prior art comprises two-stage centrifugal impellers, and gas is supplemented into an inter-stage of the impellers. After being compressed by the first stage impeller, the refrigerant needs to be diffused by a diffuser and go through guide stage of a return channel to eliminate eddy, then returns to the secondary impeller inlet. So, the refrigerant flow path is longer, and the friction loss is larger. Moreover, speed and flow direction of the inter-stage supplemented gas is often inconsistent with speed and flow direction of the main gas flow, resulting in a large mixing loss.

The embodiment of the present application provides a stator blade, comprising a blade body 1, wherein a cavity 2 is formed inside the blade body 1, and a gas supply hole 3 is formed on the blade body 1. In some embodiments, the gas supply hole 3 is provided on a suction surface of the blade body 1.

The stator blade in the present application is designed to be hollow (for example, the blade body 1 is made by casting or machining), and a plurality of micro gas supply holes 3 are provided on the back of the stator blade. Therefore, a plurality of jets can be formed on the suction surface of the stator blade through the supplemented gas to blow off the low-speed low-energy gas region formed on the suction surface, reduce the gas flow separation loss, and improve the aerodynamic efficiency of the compressor.

Further, by properly designing the position, angle and size of the gas supply hole 3, that is, the position, angle and jet velocity of the jet are reasonably organized, the suction surface separation of the stator blade can be effectively suppressed.

The present application also provides a compressor structure comprising the stator blade 4 described above. In some embodiments, the compressor structure further comprises a housing on which a gas supply passage 5 communicating with the cavity 2 of the stator blade 4 is formed.

In the above technical solution a plurality of jets are formed on the suction surface of the stator blade 4 by supplemented gas, thereby blowing off low-speed low-energy gas region formed on the suction surface, reducing gas flow mixing loss caused by the supplemented gas, thereby improving the aerodynamic efficiency of the centrifugal compressor.

In some embodiments, the compressor structure further comprises a rotor impeller 6 and a secondary impeller 7, and the output gas flow from the rotor impeller 6 enters the secondary impeller 7 through the stator blade 4. The supplemented gas is jetted from back of the stator blade 4, which can effectively reduce the temperature and specific volume of the outlet refrigerant from the primary impeller (i.e., the rotor impeller 6), and improve the aerodynamic efficiency of the secondary impeller 7. In this technical solution of the present application the primary centrifugal impeller is replaced with an axial flow impeller (i.e., the rotor impeller 6), the primary diffuser and the return channel are replaced with axial flow stator blades (i.e., the stator blades 4), thereby a compressor with the two-stage centrifugal impellers is replaced with a compressor with an axial-centrifugal combination impellers. And axial flow rotor blade has the characteristics of small size and high efficiency. Therefore, flow path of the refrigerant gas between the two compression stages is reduced, the friction loss and the like are reduced, and the aerodynamic efficiency of the centrifugal compressor is further improved.

In some embodiments, a plurality of adjustable guide vanes 8 are provided at the input side of the rotor impeller 6. In some embodiments, a diffuser is provided at the output side of the secondary impeller 7. A plurality of diffuser vanes 10 are disposed in diffuser flow passage 9 of the diffuser. A volute 11 is provided at the output side of the diffuser vanes 10.

Through the above design, the supplemented gas jetted from the back of the stator blade 4 can effectively reduce the temperature and specific volume of outlet refrigerant from the primary impeller, and improve the aerodynamic efficiency of the secondary impeller. In addition, the diffusion by the stator blades reduces the flow path of the gas flow in the diffuser flow passage, and decreases the friction loss.

The jets formed on the suction surface of the stator blade by the supplemented gas can blow off the low-speed low-energy gas region formed on the suction surface, reduce the gas flow separation loss, and improve the aerodynamic efficiency of the compressor.

The present application also provides a compressor comprising the above described compressor structure.

Of course, the above is a preferred embodiment of the present application. It should be noted that a number of modifications and refinements may be made by those skilled in the art without departing from the basic principles of the present application, and such modifications and refinements are also considered to be within the protection scope of the present application.

The invention claimed is:

1. A compressor, comprising:

a housing;

a rotor impeller, being an axial flow impeller;

a secondary impeller, being a centrifugal impeller; and a stator blade, being an axial flow blade comprising a blade body;

wherein a cavity is formed inside the blade body, and a gas supply hole is formed on the blade body;

a gas supply passage is formed on the housing in communication with the cavity of the stator blade; and the compressor is configured to allow the output gas flow from the rotor impeller to pass through the stator blade to the secondary impeller.

2. The compressor according to claim 1, wherein the gas supply hole is provided on a suction surface of the blade body.

3. The compressor according to claim 1, wherein the blade body is made by casting or machining.

4. The compressor according to claim 1, wherein an adjustable guide vane is provided at an input side of the rotor impeller.

5. The compressor according to claim 4, wherein a diffuser is provided at the output side of the secondary impeller.

6. The compressor according to claim 5, wherein a diffuser vane is provided in a diffuser flow passage of the diffuser.

* * * * *